US008142130B2

(12) United States Patent
Garcia

(10) Patent No.: US 8,142,130 B2
(45) **Date of Patent: *Mar. 27, 2012**

(54) SAFETY CONE PLACING DEVICE AND METHOD

(75) Inventor: Guadalupe C. Garcia, Tijuana (MX)

(73) Assignee: Worldwide Safety, LLC, Sacramento, CA (US)

( * ) Notice: Subject to any disclaimer, the term of this patent is extended or adjusted under 35 U.S.C. 154(b) by 243 days.

This patent is subject to a terminal disclaimer.

(21) Appl. No.: 12/313,008

(22) Filed: Nov. 13, 2008

(65) Prior Publication Data

US 2009/0274541 A1 Nov. 5, 2009

Related U.S. Application Data

(63) Continuation of application No. 12/079,419, filed on Mar. 26, 2008, now abandoned, which is a continuation of application No. 11/729,174, filed on Mar. 27, 2007, now abandoned, which is a continuation of application No. 10/871,191, filed on Jun. 18, 2004, now abandoned, which is a continuation-in-part of application No. 10/194,709, filed on Jul. 17, 2002, now Pat. No. 6,752,582.

(60) Provisional application No. 60/486,782, filed on Jul. 11, 2003, provisional application No. 60/378,874, filed on May 7, 2002.

(51) Int. Cl.
*E01F 9/014* (2006.01)

(52) U.S. Cl. ..... 414/467; 414/507

(58) Field of Classification Search ..... 414/467, 414/507

See application file for complete search history.

(56) References Cited

U.S. PATENT DOCUMENTS

| | | | | |
|---|---|---|---|---|
| 5,213,464 | A * | 5/1993 | Nicholson et al. | 414/440 |
| 5,244,334 | A * | 9/1993 | Akita et al. | 414/502 |
| 5,525,021 | A * | 6/1996 | Larguier | 414/551 |
| 6,435,369 | B1 * | 8/2002 | Poursayadi | 221/185 |
| 6,752,582 | B2 * | 6/2004 | Garcia | 414/467 |

* cited by examiner

*Primary Examiner* — Charles A Fox
(74) *Attorney, Agent, or Firm* — Lumen Patent Firm

(57) ABSTRACT

Automatic placement of safety cones from a moving vehicle is provided. The preferred safety cone would have a flexible cone part. A receptacle holds a plurality of safety cones either with the flexible cone part in non-compressed position or in spring-loaded position. The receptacle is removably attached to the vehicle. A releasing means that is attached to the receptacle is controlled and advances the safety cones in an automatic and controlled fashion, one-by-one, to different locations on a ground surface from a moving vehicle. The advantage is that it automatically handles the placement of a plurality of safety cones while driving. There would be no more need for a person to manually place the safety cones. It provides for increased road safety since it decreases or even eliminates the number of fatal or non-fatal accidents as well as chronic injuries of road-workers that are involved in placing safety cones.

1 Claim, 22 Drawing Sheets

SAFETY CONE PLACING DEVICE AND METHOD

CROSS-REFERENCE TO RELATED APPLICATIONS

This application is a continuation of U.S. patent application Ser. No. 12/079,419 filed Mar. 26, 2008 now abandoned.

U.S. patent application Ser. No. 12/079,419 filed Mar. 26, 2008 is a continuation of U.S. patent application Ser. No. 11/729,174 filed Mar. 27, 2007 now abandoned. U.S. patent application Ser. No. 11/729,174 filed Mar. 27, 2007 is a continuation of U.S. patent application Ser. No. 10/871,191 filed Jun. 18, 2004 now abandoned. U.S. patent application Ser. No. 10/871,191 is a continuation-in-part of U.S. patent application Ser. No. 10/194,709 filed Jul. 12, 2002 (U.S. Pat. No. 6,752,582 with issue date of Jun. 22, 2004), which claims priority from a U.S. Provisional Patent Application 60/378,874 filed on May 7, 2002, all of which are incorporated herein by reference.

U.S. patent application Ser. No. 10/871,191 also claims priority from a U.S. Provisional Application 60/486,782 filed Jul. 11, 2003, which is incorporated herein by reference.

U.S. patent application Ser. No. 10/871,191 further claims priority from a pending U.S. patent application Ser. No. 10/131,316 filed Apr. 23, 2002 (U.S. Pat. No. 6,766,760 issued Jul. 27, 2004), which claims priority from U.S. Provisional Patent Applications No. 60/351,557 filed Jan. 23, 2002 and No. 60/360,141 filed Feb. 22, 2002, all of which are incorporated herein by reference.

U.S. patent application Ser. No. 10/871,191 further claims priority claims from a pending U.S. patent application Ser. No. 10/763,399 filed Jan. 23, 2004 (U.S. Pat. No. 7,007,630 issued Mar. 7, 2006), which claims priority from a pending U.S. patent application Ser. No. 10/131,316 filed Apr. 23, 2002 (U.S. Pat. No. 6,766,760 issued Jul. 27, 2004) and from a U.S. Provisional Patent Application No. 60/442,355 filed Jan. 23, 2003, all of which are incorporated herein by reference.

FIELD OF THE INVENTION

The present invention relates generally to road safety. More particularly, the present invention relates to a device and method for automatically placing safety cones from a moving vehicle to areas where it is necessary to alert or divert vehicles, watercrafts, aircrafts or pedestrians.

BACKGROUND

Traffic or safety cones are routinely used to direct motorists and pedestrians away from obstacles or dangerous areas. Safety cones are usually brightly colored, hollow conical shaped devices made of a synthetic, rubber or other plastic (See for example U.S. Pat. No. 2,333,273 to Scanlon et al.). Commonly, safety cones are placed by an individual who is manually delivering and/or placing these cones to a particular place on, for instance, but not limited to, a freeway, a road, a street, an intersection, or the like. In other cases, a vehicle can take an individual to a particular place, however it is still the individual that needs to place the safety cones by hand once the vehicle has arrived at that particular place. This task is labor-intensive, slow and could easily result in chronic back-injuries in those individuals who perform such a task routinely. Automation of this task would be preferred. However, with the current safety cones, being fairly rigid and having a tendency to easily fall over, placing the cones to a particular place in an automatic fashion from a moving vehicle would not be practical. Therefore, previous attempts of cone delivery or placing devices have not been successful. Furthermore, if such an automation would take place with the current fairly rigid safety cones, and since some or most of these cones would not able to maintain their upright position, the fallen cones need to be re-placed to their upright position by an individual so that these cones can be useful to the public as safety cones. Accordingly, there is first a need for improved safety cones or marker devices to enable automatic placement from a moving vehicle. Second there is a need for a device and method to automatically place such improved safety cones at a particular place.

SUMMARY OF THE INVENTION

The present invention provides a device, method and system for automatically placing a safety cone to a desired position on a ground surface from a moving vehicle. The key idea of the present invention is that there is a receptacle that holds a plurality of safety cones. In one embodiment, a cassette is used to hold the plurality of safety cones. The cassette can be removably attached inside the receptacle. A releasing means which is attached to the receptacle is controlled and advances the safety cones in an automatic and controlled fashion to desired locations on a road, street, freeway, intersection, or the like.

The device of the present invention includes a receptacle for holding a plurality of safety cones. The preferred selection of safety cones that would enable automatic placement of safety cones from a moving vehicle with the device of the present invention is a safety cone that includes a flexible means positioned over a base. The preferred flexible safety cone is in contrast to the relative rigid conventional safety cones. In a preferred embodiment, the flexible means is a coil in a cone shape that can easily resist perturbations (e.g. during release from the moving vehicle, during landing on a ground surface, etc.). The safety cones could be placed inside the receptacle or inside the cassette in a form whereby the flexible is in non-compressed position or in a compressed position such that the flexible means is spring-loaded. The spring-loaded position could promote the release of the safety cones from the receptacle to a particular place. In one embodiment, the safety cone includes a cone shaped material that could be positioned inside the flexible means of a first safety cone to guide, hold in place or assist in spring loading the flexible means of a second safety cone when the first safety cones is stacked on top of the second safety cone. In another embodiment, the base of such a flexible safety cone could have a reinforcement placed within the base to prevent bending of the base due to the spring-loaded extension force of other safety cones in the stack. In yet another embodiment, the flexible safety cone preferably includes at least three modular components such as a base, flexible means (e.g. coil), cover that is preferably a mesh-based material that preferably at most minimally resists the movement of the flexible means. The modular components could be assembled by means of a ring or a click-connect (i.e. referred to as modularly combined), which would allow easy replacement of one or more of the components. In addition, the use of modular components would allow the use of recycle components, such as a rubber base, so that one or more of these components could be recycled.

The device further includes a releasing means for releasing one of the plurality of safety cones to a desired position on a ground surface. The releasing means advances one safety cone to a position on the ground, while it prevents the remainder of the plurality of safety cones from being released from the receptacle. To control the timing of each release the device of the present invention could also include a control means to control the releasing means.

The method of the present invention for automatically placing a safety cone from a moving vehicle includes providing a receptacle for holding a plurality of safety cones. In one embodiment a cassette is provided to hold the plurality of safety cones. The method further includes providing safety cones with a flexible cone part or a flexible means. The safety cones could be placed inside the receptacle in a non-compressed position of the flexible means or a compressed (spring-loaded) position of the flexible means. In one embodiment the safety cones are provided as modularly combined safety cones. The method further includes providing a releasing means for releasing one out of the plurality of safety cones, one at a time, from the receptacle to a position on a ground surface, while preventing the remainder of the plurality of safety cones from being released from the receptacle. A control means is provided to control the release of each safety cone.

The system of the present invention for automatically placing safety cones from a moving vehicle includes a receptacle for holding a plurality of safety cones, whereby the receptacle is removably attached to the vehicle or removably positioned inside the trunk of a vehicle. The system further includes a releasing means for releasing one out of the plurality of safety cones, one at a time, to a position on a ground surface. During the release the releasing means prevents the remainder of the plurality of safety cones from being released from the receptacle. The system further includes a control means to control the releasing means and placement of the plurality of safety cones at different positions on the ground surface.

In view of that which is stated above, it is the objective of the present invention to automatically place safety cones to a ground surface.

It is still another objective of the present invention to automatically deliver safety cones to a ground surface from a moving vehicle.

It is still another objective of the present invention to provide a receptacle attached to a vehicle for holding a plurality of safety cones.

It is still another objective of the present invention to provide a releasing means for releasing the safety cones one-by-one to desired and different positions on a ground surface.

It is yet another objective of the present invention to provide a control means to control the timing of the release of the safety cones.

It is yet another objective of the present invention to provide one or more sensors to further automate the delivery and placement of safety cones.

It is yet another objective of the present invention to use safety cones which each have a flexible cone part that is detachably placed over a base.

It is yet another objective of the present invention to use safety cones stacked with the flexible means of each safety cone in a spring-loaded position.

It is yet another objective of the present invention to use safety cones with modular components.

The advantage of the present invention is that it provides automatic placement of a plurality of safety cones from a moving vehicle. This is enabled by the use of safety cones with a flexible means that easily resists perturbations and could optionally be held in spring-loaded position in the receptacle to assist in the release from the receptacle. There would be no more need for a person to manually deliver and place the safety cones. Human interaction would only be required to control the release of one or more safety cones. The present invention therefore provides for increased safety. Furthermore, the time it takes to deliver and place the safety cones is significantly decreased compared to manual placement. It would also allow the driver of the vehicle delivering the safety cones to no longer worry about the cone placement and could therefore pay more attention to the accident or event that initiated the safety cone placement.

BRIEF DESCRIPTION OF THE FIGURES

The objectives and advantages of the present invention will be understood by reading the following detailed description in conjunction with the drawings, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

The present invention provides a device, method and system for automatically placing a safety cone to a desired position on a ground surface from a moving vehicle. The key idea of the present invention is that there is a receptacle that holds a plurality of safety cones. A releasing means which is attached to the receptacle is controlled and advances the safety cones in an automatic and controlled fashion, one-by-one, to desired locations on a road, street, freeway, intersection, or the like.

Figure 1:
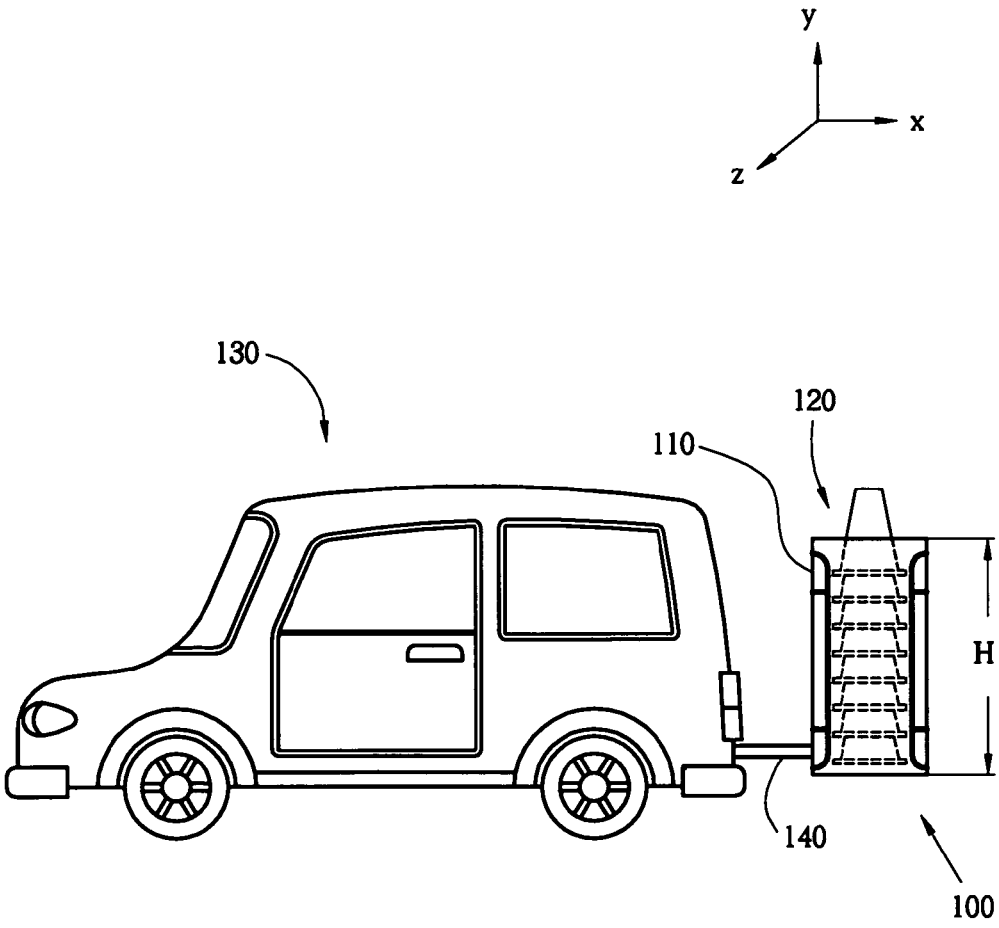
FIG. 1 shows an exemplary embodiment of a device removably attached to a vehicle according to the present invention.

FIG. 1 shows a device 100 that includes a receptacle 110 for holding a plurality of safety cones 120. Device 100 is removably attached to a vehicle 130 that is carrying device 100. Device 100 could be removably attached to any location of vehicle 130. However, the preferred location of attaching device 100 to vehicle 130 is somewhere at the back or near the back of vehicle 130. The ultimate location for device 100 is dependent on the type of vehicle and/or the type of service the vehicle intends to provide. It would, for instance, be possible that the best location for device 100 is at one of the sites of vehicle 130. Device 100 could be removably attached to vehicle 130 with any type of connecting or attaching means 140 that provides a rigid, movable, adjustable and/or pivotal connection or attachment. Preferably the attachment is such that it would require no or minimal adjustment to the vehicle so that no special adjustments or special vehicles are required. As a person of average skill in the art would readily appreciate, connecting or attaching means 140 could further include means (not shown), such as a linear or rotary motor, to translate and/or rotate device 100 around its X-, Y-, and Z-axes to establish the proper position of device 100 relative to vehicle 130.

Figure 2:
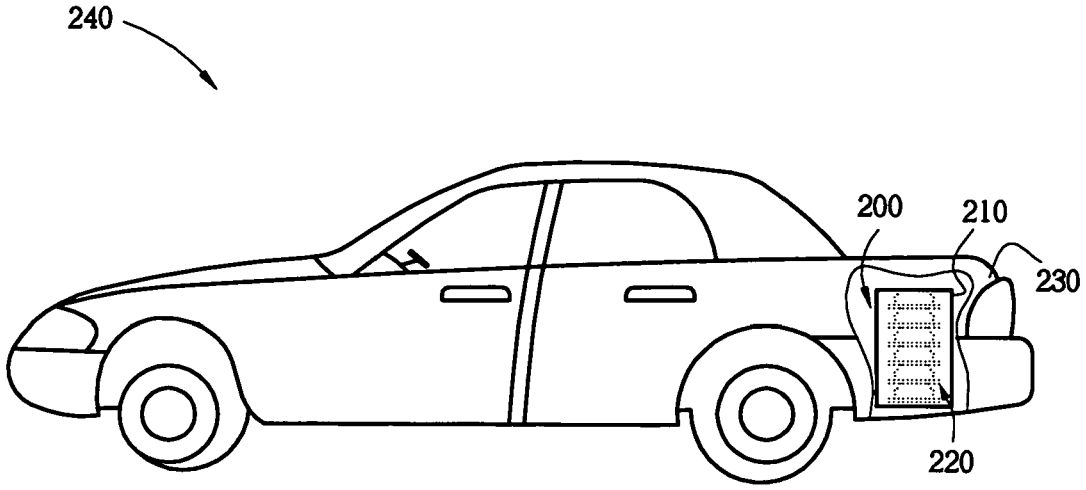
FIG. 2 shows an exemplary embodiment of a device removably positioned in a trunk of a vehicle according to the present invention.

FIG. 2 shows a device 200 that includes a receptacle 210 for holding a plurality of safety cones 220. Device 200 is removably positioned inside the trunk 230 of a vehicle 240. Device 200 could be removably attached to any location inside trunk 230. To release a safety cone from the bottom of the trunk requires an opening big enough to release a safety cone to a ground surface.

Figure 3:
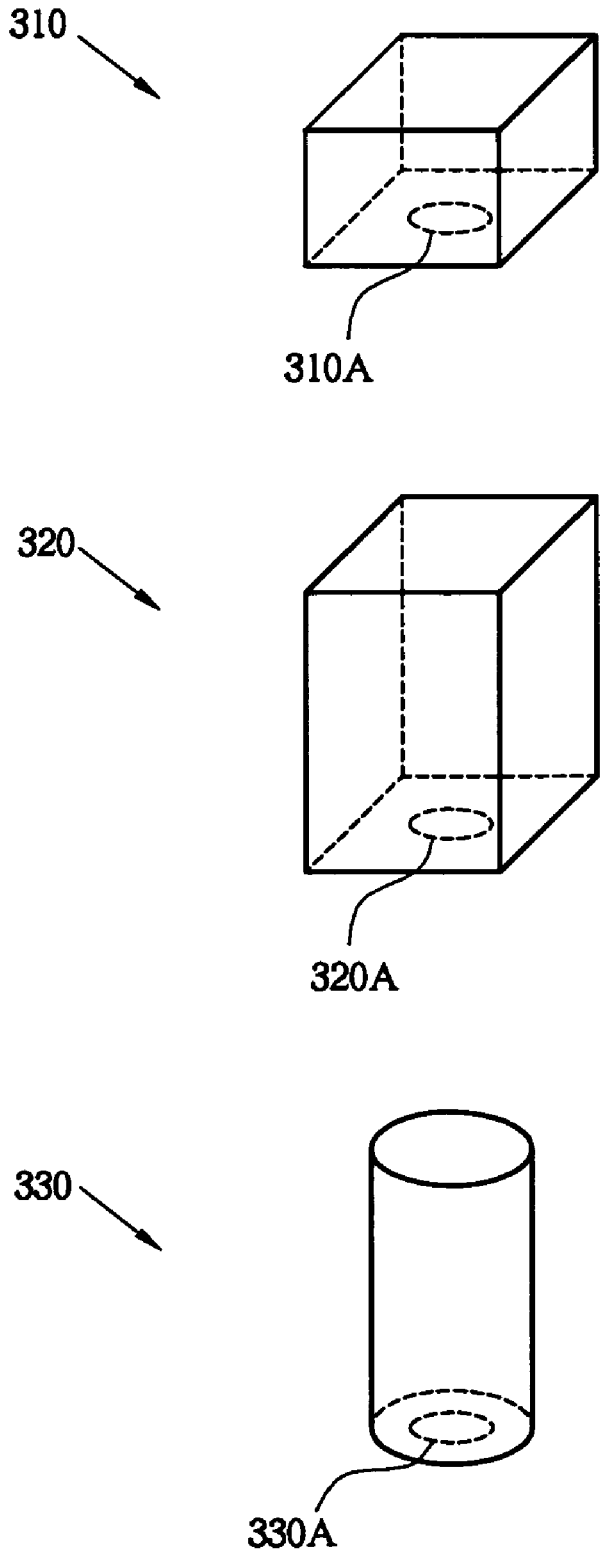
FIG. 3 shows exemplary embodiments of a receptacle according to the present invention.

Receptacle 110, 210 could take any type of shape, such as, but not limited to, a square 310, rectangular 320, cylindrical 330 or the like as shown in FIG. 3. Furthermore, receptacle 110, 210 could be an enclosed structure, partially enclosed structure, structure with (movable) lid, or a wire frame structure as long as the plurality of safety cones can be held inside receptacle 110, 210 without falling out receptacle 110, 210 or tipping over. The requirement for receptacle 110, 210 is that it needs to allow a user to place a plurality of safety cones inside receptacle 110, 210. Another requirement for receptacle 110, 210 is that it has an opening 310A, 320A or 330A or a opening means (not shown, e.g. a sliding door or flaps) to create an opening through which the safety cone, that is about to be released and placed to a position on a surface, could pass. Opening 310A, 320A or 330A is preferably situated at the bottom of receptacle 110, 210. Yet another requirement for receptacle 110, 210 is that it has enough height H so that it could host enough safety cones that are adequate for the intended activities or events without the safety cones tipping over or falling out of receptacle 110, 210. As is discussed infra, the preferred safety cones for use with the present device have a flexible cone part or flexible means that would make it possible to place the safety cones inside the receptacle in a fully extended position (flexible means in original, non-compressed, position) or spring-loaded position (flexible means in compressed position). An advantage of storing the safety cones in a spring-loaded position is that the spring tension of the flexible cone part would assist in releasing a safety cone from the receptacle to a ground surface. This could also be referred to as "shooting" a safety cone from the receptacle, hence the device being referred to as "cone shooter".

The receptacle further includes a releasing means for releasing one of the plurality of safety cones at a time to a position on a ground surface, while the releasing means prevents the remainder of the plurality of safety cones from being released from the receptacle. As a person of average skill might readily appreciate, releasing means could therefore also be referred to as a holding and releasing means. In general, the receptacle includes one or more elements that are movably attached to the receptacle to release one of the plurality of safety cones. The same one or more elements could also be used to prevent the remainder safety cones from being released from the receptacle. However, as a person of average skill in the art would readily appreciate, the receptacle could also have one or more elements specifically designed for releasing the safety cone, whereas other one or more elements could be specifically designed for holding the remainder safety cones in the receptacle. The one or more elements could move between a holding position to hold the plurality of safety cones and a releasing position to release one of the plurality of safety cones while preventing the remainder of safety cones from being released from said receptacle. The one or more elements could also be arranged in a pattern (such as a propeller-shape) whereby the elements are attached to a common structure. It is then the common structure that is movably attached to the receptacle.

Figure 4:
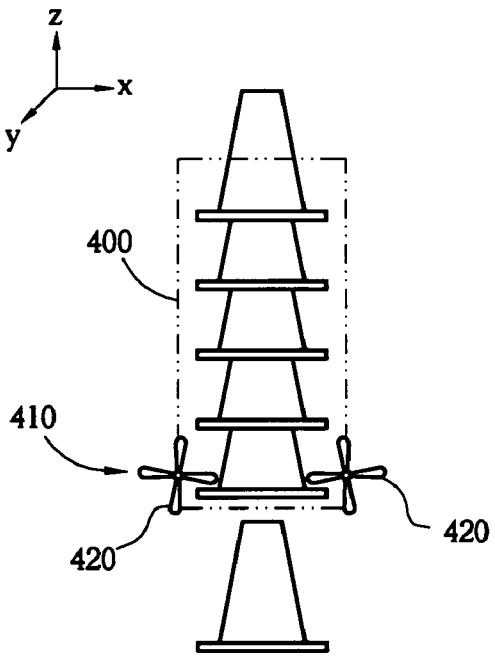
FIGS. 4-6 show exemplary embodiments of a releasing means according to the present invention.
Figure 5:
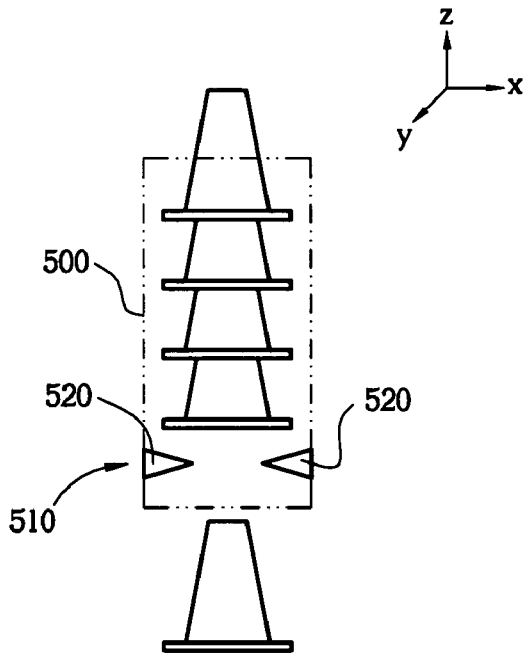
Figure 6:
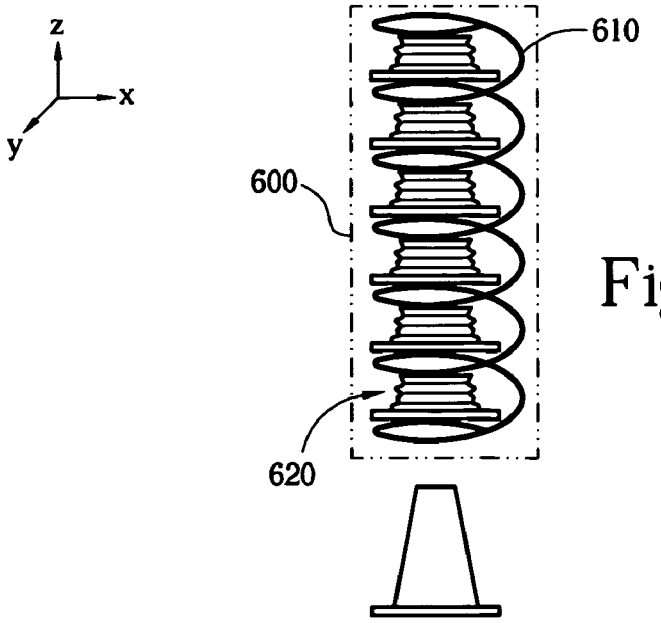

FIGS. 4-6 show exemplary receptacles 400, 500 and 600 respectively, including exemplary releasing means 410, 510 and 610 respectively, that are capable of holding a plurality of safety cones and capable of releasing the safety cones, one at a time. Releasing means 410, 510 and 610 are attached to receptacle 400, 500 and 600, respectively as shown by exemplary embodiments in FIGS. 4-6. Releasing means is preferably attached near the bottom part of the device. The key idea of releasing means is that once releasing means advances it releases a safety cone and the remaining safety cones in the device then advance downward until it is their turn to be released. As a skilled artisan in the art to which this invention pertains would readily appreciate, several different releasing means could be used and the present invention is in no way limited to the particular embodiments 410, 510 and 610 as they are described below with reference to FIGS. 4-6. In addition, the present invention is not limited to release non-compressed cones (as long as the cones have a flexible cone part to resist perturbations) or compressed (spring-loaded) cones.

FIG. 4 shows receptacle 400 with releasing means 410. Releasing means 410 includes one or two "propeller-like" devices 420 that rotate around the Y-axis. If two "propeller-like" devices 420 are used then both "propeller-like" devices 420 are aligned as shown in FIG. 4 and advance in the same manner as a person of average skill in the art would readily appreciate. The exemplary embodiment shown in FIG. 4 is not limited to one or two "propeller-like" devices 420, since it would also be possible to have a plurality of "propeller-like" devices 420 distributed over the bottom or the vertical length of delivering device 400. In this example of FIG. 4, the propeller-like device could be seen as one or more elements, in this case four, that are attached to a common structure. The common structure is then movably attached to receptacle 400.

FIG. 5 shows receptacle 500 with releasing means 510. Releasing means 510 includes one or two elements 520 that could either rotate downward around the Y-axis, translate in-and-out along the X-axis, rotate around the Z-axis, or a combination of translation(s) and/or rotation(s) around the different axes. If two elements 520 are used then both elements 520 are aligned as shown in FIG. 5 and operate similar, as a person of average skill in the art would readily appreciate. Elements 520 are not limited to a particular shape and could for instance have a triangular shape, square shape, flat shape or round shape.

The exemplary embodiment of FIG. 4 or 5 are also not limited to one or two elements 420 or 520, since it could also be possible to have a plurality of elements 420, 520 distributed over the vertical length of delivering device 400 or 500 respectively, for instance to assist in positioning the safety cones or to assist in positioning the safety cones in their spring-loaded position.

FIG. 6 shows receptacle 600 with releasing means 610. Releasing means 610 includes a spiral element that could rotate around the Z-axis. The idea here is that the safety cones are placed in spiral element, preferably in a spring-loaded position 620. The safety cones will be released once the spiral rotates. Releasing means 610 advances a safety cone, as one of average skill in the art would readily appreciate. Once the safety cone is released, the safety cone decompresses from its spring-loaded position.

Figure 7:
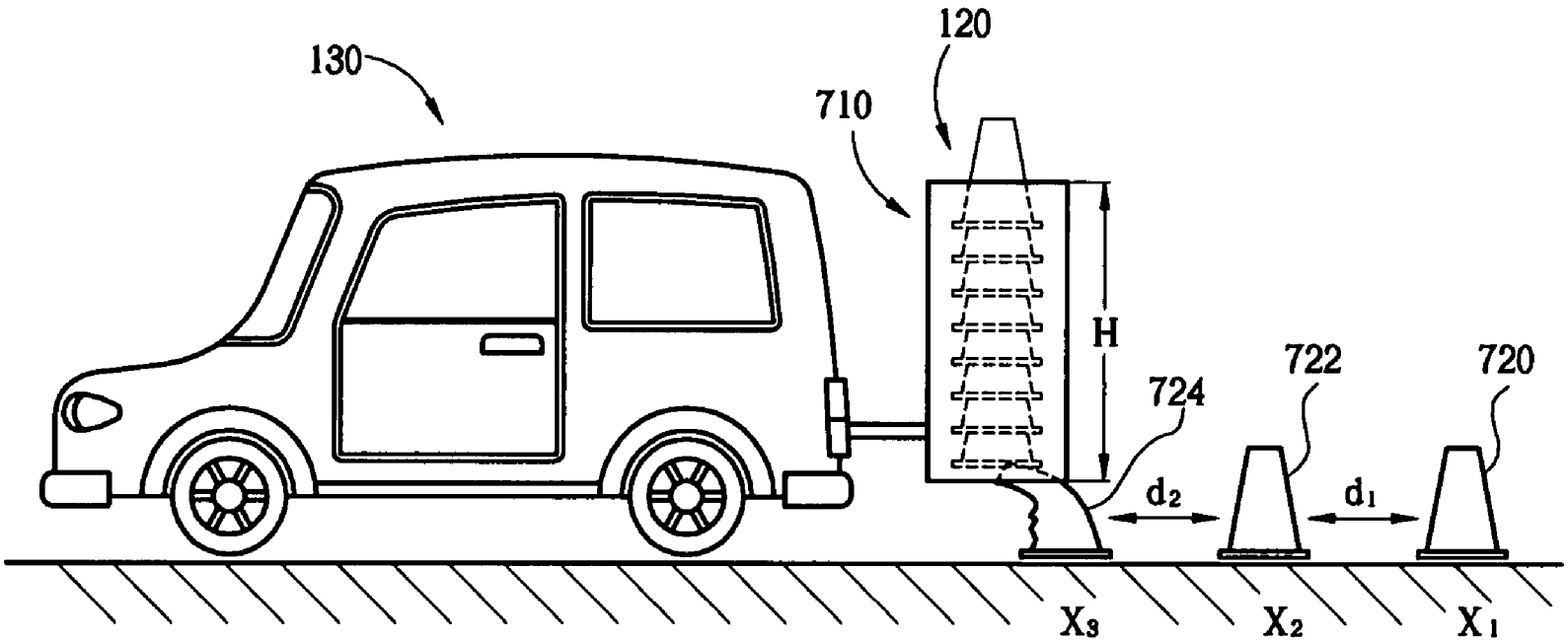
FIGS. 7-8 show examples of placing safety cones according to the present invention.
Figure 8:
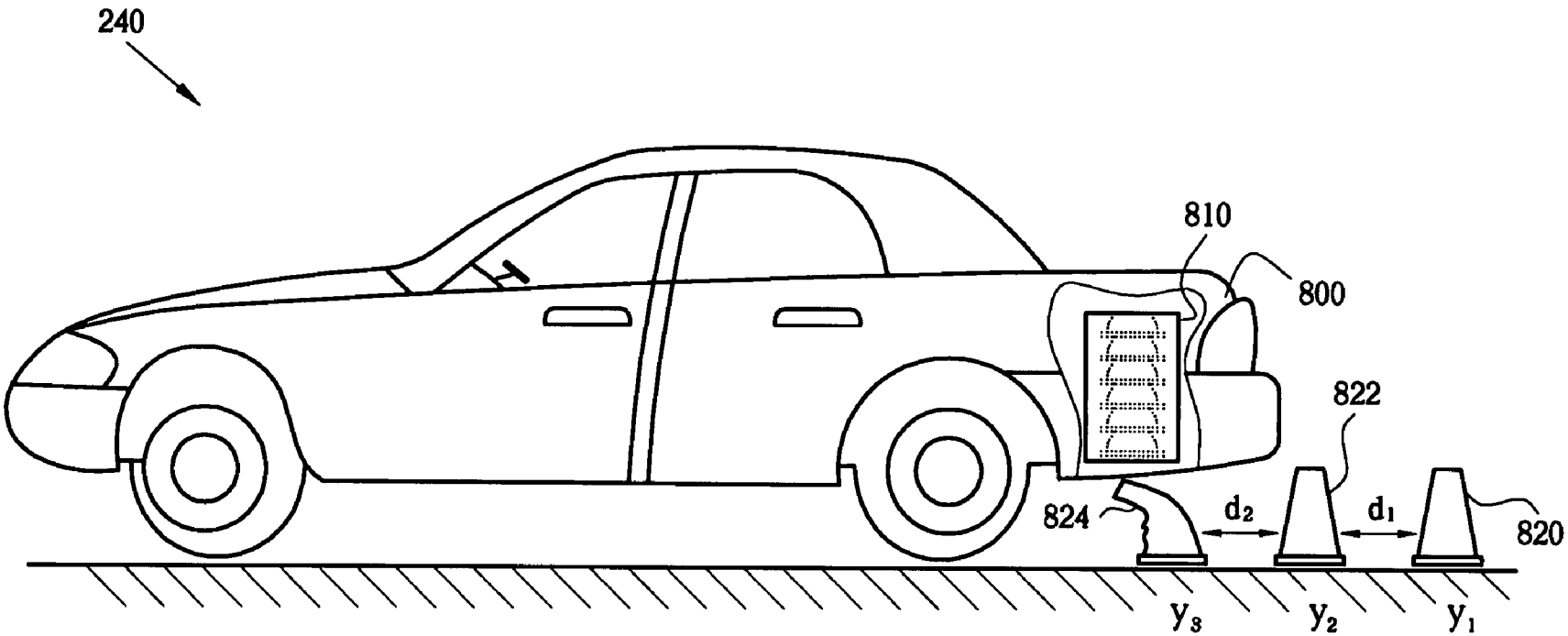

As shown in FIG. 7, receptacle 710 releases one safety cone at the time to a particular place from moving vehicle 130. For instance, safety cone 720 was released and delivered at place $X_1$ at time $T_1$, safety cone 722 was released and delivered at place $X_2$ at time $T_2$, and safety cone 724 is being released and delivered at place $X_3$ at time $T_3$. As a person of average skill would readily appreciate, device 710 could place one or more safety cones as many as there are hosted in receptacle 710. As will be discussed infra in more detail, the present invention would preferably require the use of safety cones that have a flexible cone part that could be easily bend or undergo perturbations during the placement of the safety cones without jeopardizing a correct, upright placement of the safety cones as is shown in FIG. 7. In this case, the height of device 710 with respect to the ground would then not really matter as long as there is enough space between the device and the ground surface to release a safety cone and to place a safety cone to the ground surface. As shown in FIG. 8, a safety cone could also be released to a desired position on a ground surface from trunk 800 of car 240. Receptacle 810 places one safety cone at the time to a particular place. For instance, safety cone 820 was released and delivered at place $Y_1$ at time $T_1$, safety cone 822 was released and delivered at place $Y_2$ at time $T_2$, and safety cone 824 is being released and delivered at place $Y_3$ at time $T_3$.

Important to note is that the weight of the bottom part or base of the safety cone ensures the safety cone to move downwards when it is released and the flexible cone part would automatically follow the base of the safety cone. The flexible top part will "flop" (and pop-up if spring-loaded) to its upright position. In addition, if the safety cone is placed in spring-loaded position in the receptacle, then the spring tension would assist in releasing the safety cone from the receptacle.

Figure 9:
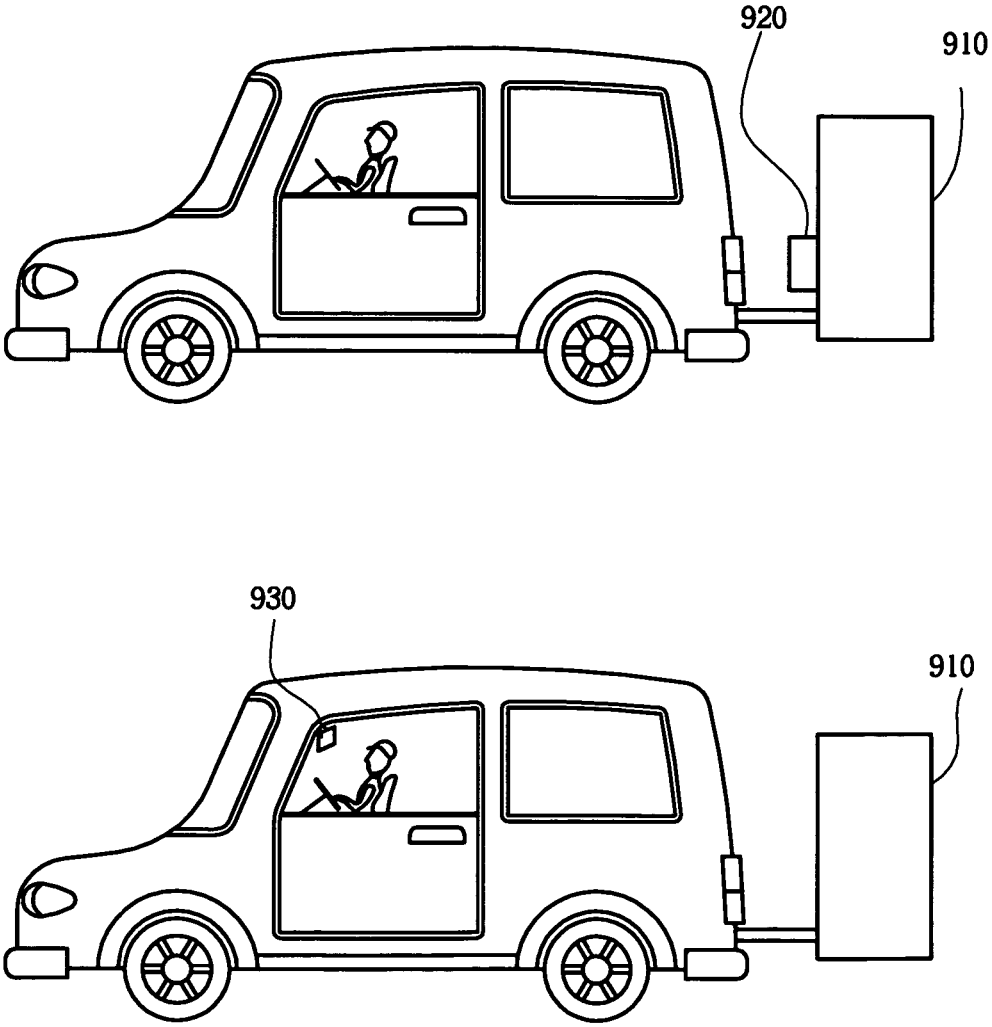
FIG. 9 shows exemplary embodiments of a control means according to the present invention.

To release a safety cone in an automatic fashion, a control means 920 is included with receptacle 910 to control the releasing means as shown in FIG. 9. Control means 920 controls the timing of the release of one of the plurality of safety cones. Control means 920 is not limited to controlling the timing of one safety cone, since it could easily control the timing of two or more safety cones. In case a plurality of safety cones would need to be placed, then control means 920 could control the release of the safety cones, one-by-one, so that they are placed at equal distance, variable distance from each other, or a combination of equal or different distances.

Figure 10:
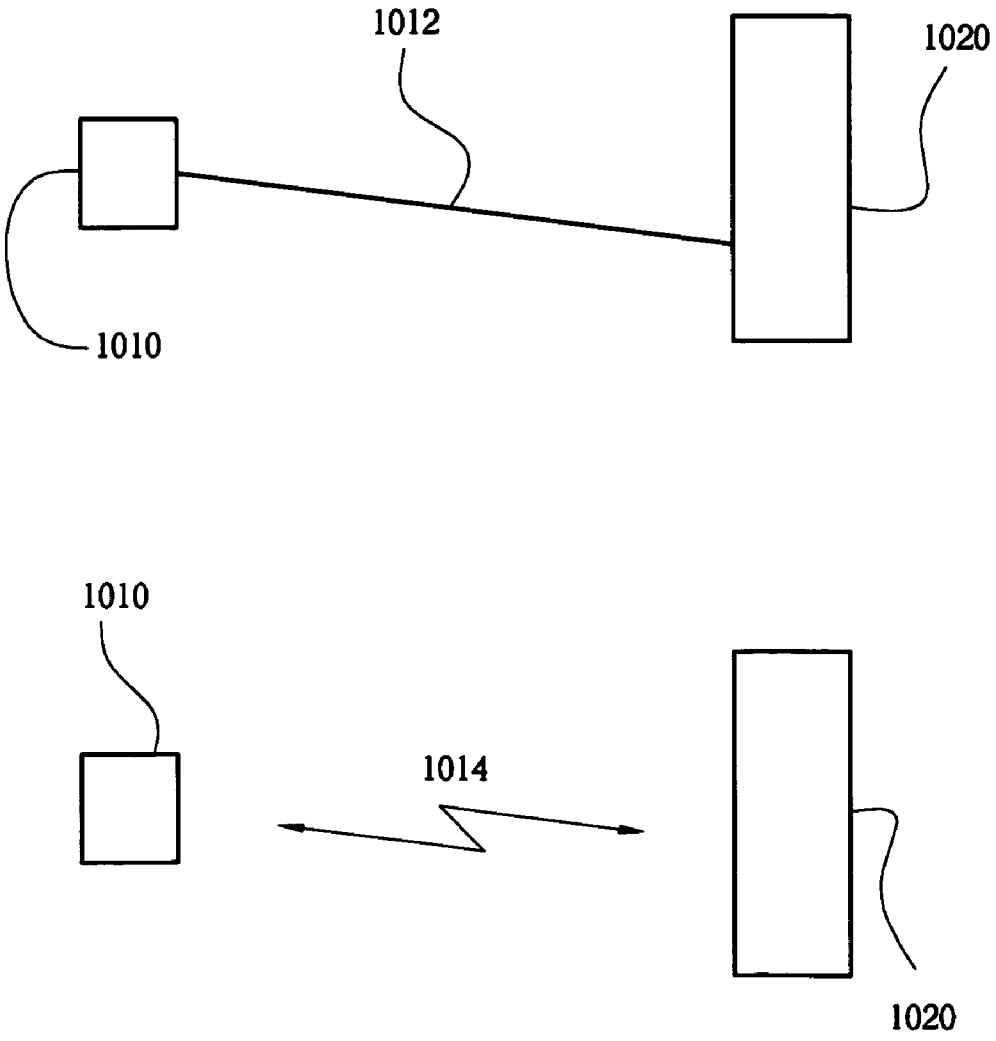
FIG. 10 shows exemplary communication means between the control means and the releasing means according to the present invention.

As shown in FIG. 9, device 910 includes a control means 920 to control the operation of device 910 to release a safety cone, one at the time. Control means 920 could be in close proximity to device 910 or integrated with device 910, however the present invention is in no way limited to the position of control means 920 relative to device 910 as long as control means 920 could be controlled or operated by a user, as one of average skill in the art would readily appreciate. However, having control means in close proximity to the driver of the vehicle would be preferred as it is shown by control means 930, so that the driver can continue to drive the car and/or focus on the situation or accident that initiated the placement of the safety cones, while releasing safety cones. Control means 1010 communicates with device 1020 either via an electrical wire connection 1012 or via a wireless connection 1014 as shown in FIG. 10.

Figure 11:
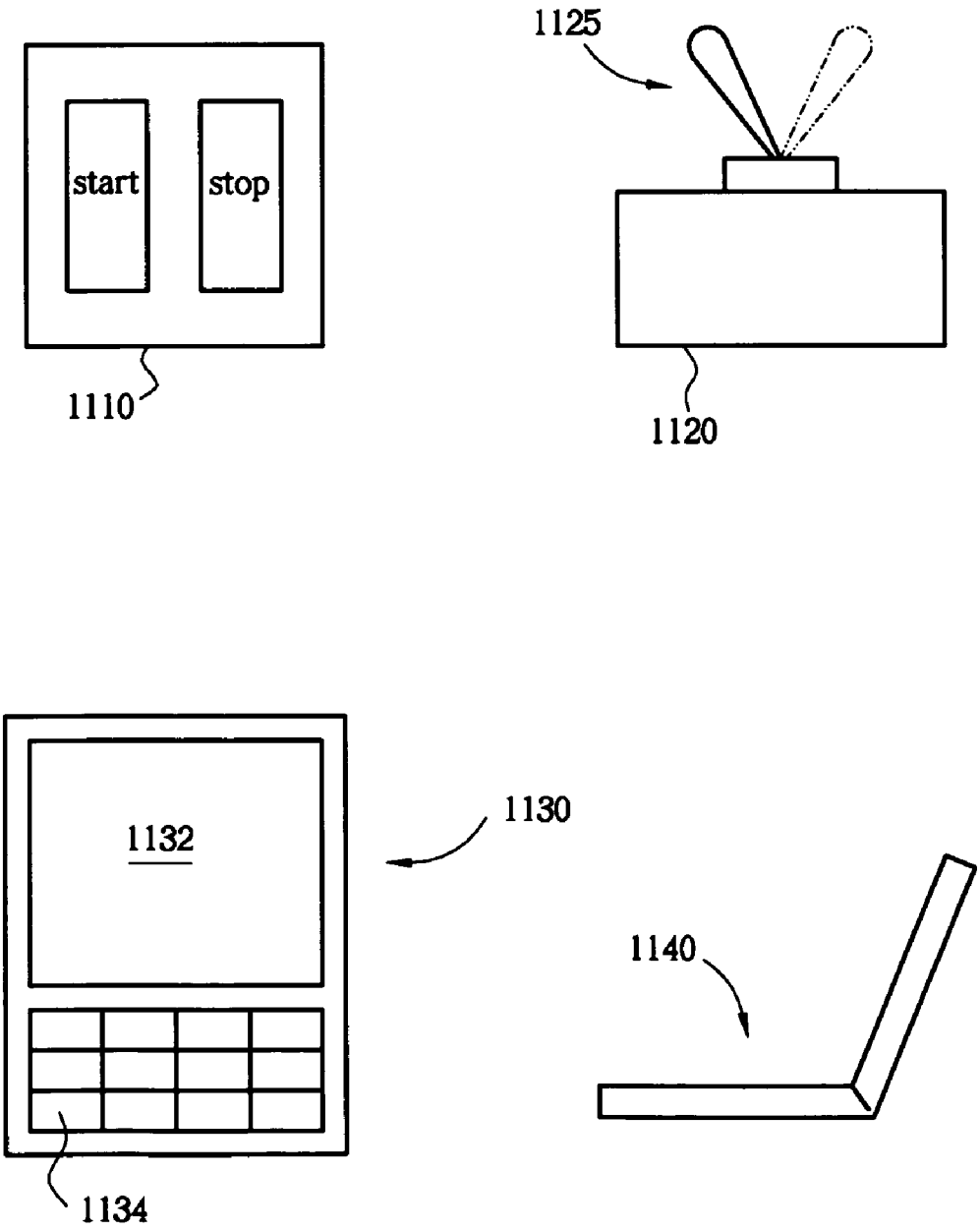
FIG. 11 shows exemplary embodiments of different control means according to the present invention.

As shown in FIG. 11, control means could include a small touch screen/panel 1110 with a start and stop button, a switch box 1120 with one or more switches 1125, or the like, to control a release of one or more safety cones. However, control means of the present invention is not limited to touch screen/panel 1110 or a switch box 1120, since it could also be a personal digital assistant 1130 with a touch-screen or display 1132 and a keyboard 1134, or other computer device such as, but not limited to, a laptop 1140 to communicate with the releasing means. Furthermore, control means could also receive voice commands (not shown), which are then interpreted by the control means and communicated to the releasing means. The basic parameters to be controlled by the control means are the start and stop of the release of a single safety cone or a plurality of safety cones in continuity. However, as one of average skill in the art would readily appreciate, the control means could be more sophisticated in that it could automatically control the timing of subsequent safety cones once the start signal has been provided. For instance, one or more sensors that could provide, for instance, distance information to the control means could be used to sense the distance traveled by the vehicle and then based on the distance traveled control the next release. In one embodiment, the cruise control of the car could be utilized to control the release. In the example of a more sophisticated control, the control means only triggers the start of the release of the first safety cone and the subsequent release of one or more safety cones follows automatically in a controlled fashion with the cones being released and placed at a preferred distance from each other (see for instance $X_1$ and $X_2$ in FIG. 7, or $Y_1$ and $Y_2$ in FIG. 8). The distance can, for instance, be programmed or preset in the control means, since it could be easily gathered or calculated by the control means, given the feedback or sensory information over the distance, time and/or speed that the vehicle has traveled, as one of average skill in the art would readily appreciate. Another example is that control means could include one or more schedules to schedule the release and delivery that could either be programmed or entered for a particular event through a user interface, graphical user interface or touch panel. In other words, a user could either manually control the start and stop by manually control the delivering device, or could control the start and stop of an automatic release schedule, whereby the automatic release schedule includes a small control program using sensory or feedback information as input and control signals to control means as output. As one of average skill in the art would readily appreciate, such an automation would be desirable and preferred, since a person driving the vehicle would no longer have to worry about the correct placement of the safety cones and whether or not they are falling over or not. Furthermore, such an automated delivery schedule would be much faster than current procedures of manually delivering the safety cones. It would be more efficient, faster and also reduces or even eliminates the physical stress on individuals who used to be responsible for placing the safety cones manually. The present invention could also include sensors that check or verify whether a safety cone is actually released and placed correctly. Examples of such sensors are, for instance, different types of optical sensors or pressure sensors.

As discussed supra, the preferred safety cone to be used in combination with the device of the present invention is a safety cone that would stay upright upon release from the receptacle of a moving vehicle. Furthermore, as mentioned supra, the present invention would also prefer and require the use of safety cones that could be easily bend, or undergo perturbations during the placement of the safety cones without jeopardizing a correct, upright placement of the safety cones as is illustrated in FIGS. 7-8. FIGS. 12-20 show exemplary embodiments of a safety cone that would be preferred in combination with the device of the present invention For additional and/or other teachings regarding this safety cone, the reader is referred to pending U.S. patent application Ser. No. 10/131,316 filed Apr. 23, 2002 and pending U.S. patent application Ser. No. 10/763,399 filed Jan. 23, 2004, all of which are incorporated herein by reference. The present invention would not be limited to this safety cone as long as the selected safety cone would be able to be released to an upright and stable position without tipping or falling over upon release from the receptacle, i.e. resist perturbations. Furthermore, any other safety cone would need to have the possibility to spring-load the flexible cone part so that compression tension can be utilized during the release of the safety cone to promote the release as well as to make the release a fast occurring event.

Figure 12:
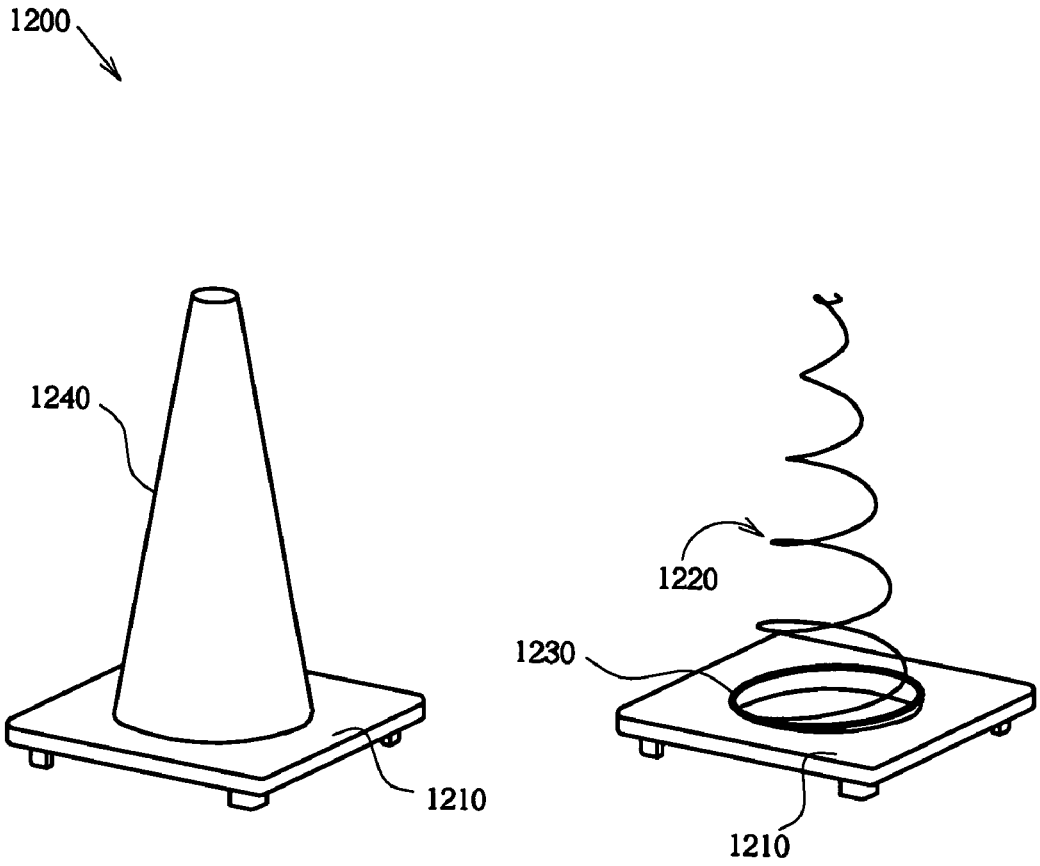
FIG. 12 shows a preferred safety cone with a flexible means according to the present invention.
Figure 13:
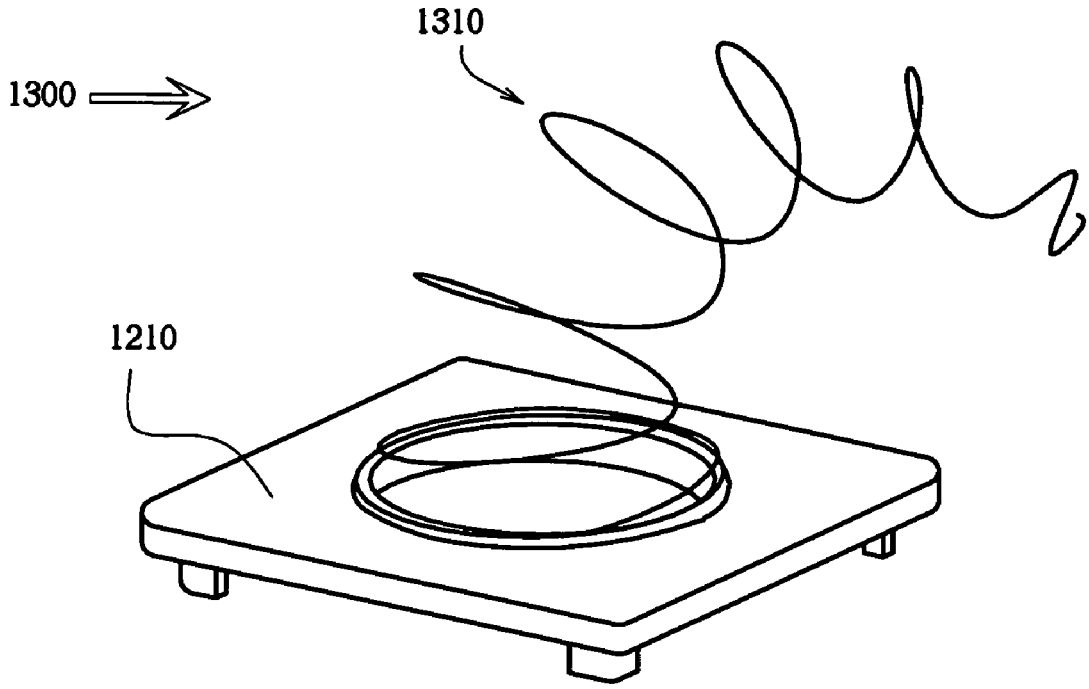
FIGS. 13-14 show the safety cone deviated from its original position (shown in FIG. 12) due to a perturbation according to the present invention.
Figure 14:
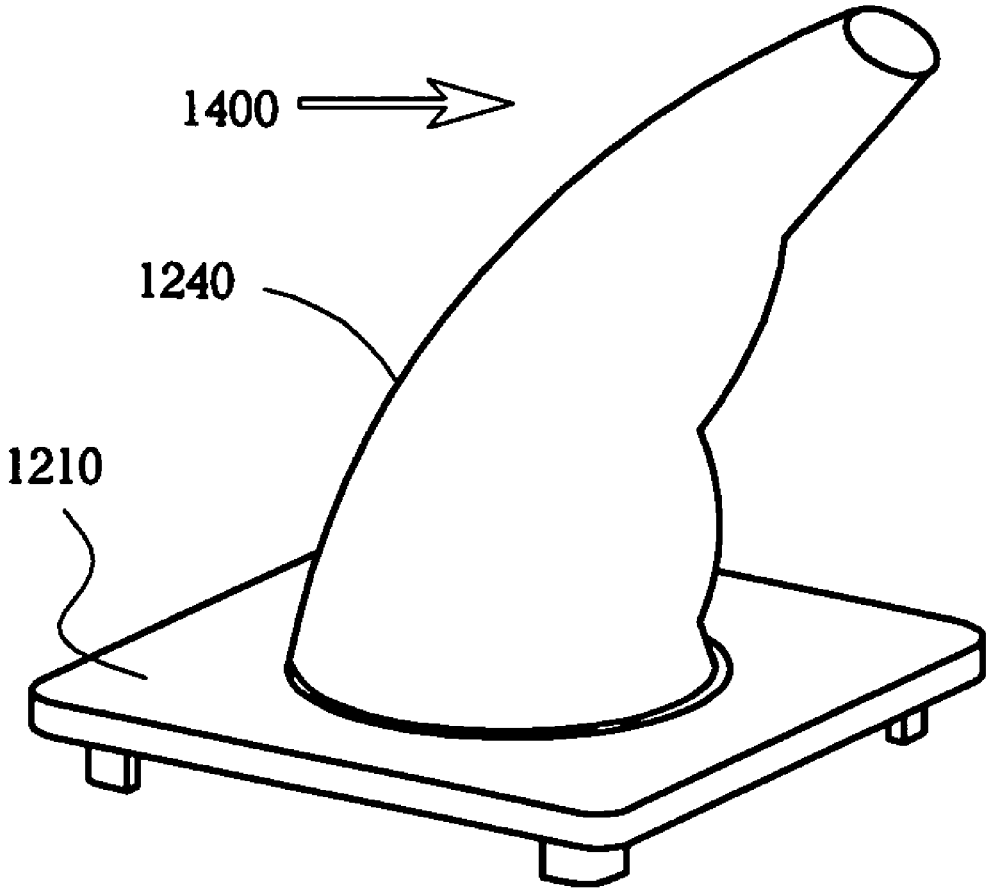

As shown in FIG. 12, safety cone 1200 includes a base 1210 and a flexible means 1220 that is positioned over base 1210. The bottom part 1230 of flexible means 1220 is removably attached to base 1210. As a person of average skill in the art would readily appreciate, different means and ways could be employed to attach or combine flexible means 1220 and base 1210. Flexible means 1220 is, for instance, but not limited to, a coil in a cone shape and maintains in an original upright position in absence of a perturbation as shown in FIG. 12. However, flexible means 1310 deviates from this original position in presence of a perturbation 1300 and 1400 as shown in FIGS. 13 and 14, respectively, or a perturbation from being released from a receptacle or being placed to a ground surface from a moving vehicle as shown in FIGS. 7-8. The flexible means has an impulse response to these type of perturbations that is fast enough to respond to the perturbations without jeopardizing the stability and placement of the safety cone. In one embodiment the flexible means is capable of bending up to a horizontal position with respect to said base (See also pending U.S. patent application Ser. No. 10/131,316 filed Apr. 23, 2002 and pending U.S. patent application Ser. No. 10/763,399 filed Jan. 23, 2004). The flexible means restores from a deviated position back to the original position after the perturbation disappears or is removed. Furthermore, the safety cone includes a cover 1240 to cover flexible means 1220 and 1310 as shown in FIGS. 12-13, respectively. The cover preferably at most minimally resists the movements of the flexible means to maintain the flexibility of the flexible means. In one embodiment, cover is made of a mesh-based material 1900 (See FIG. 19) to easily let wind, air, water, or the like pass as well as to increase the movability of the cover to follow the movement of the flexible means. A reflective material 1910 could be placed on the mesh at places on the cover where the reflective material would be desired or in some cases required. The advantage of the flexible safety cone over previous rigid safety cones is that the flexible safety cone can more easily resist various types of perturbations without falling over due to its flexible design. Therefore these safety cone would be a preferred candidate and preferred safety cone that could be used for automatically placing safety cones from a moving vehicle at a particular place on the road, freeway or any other area, since the chances of falling over are significantly reduced or minimized as well as the additional benefit of using the spring-loaded tension to promote the release of the safety cone.

Figure 15:
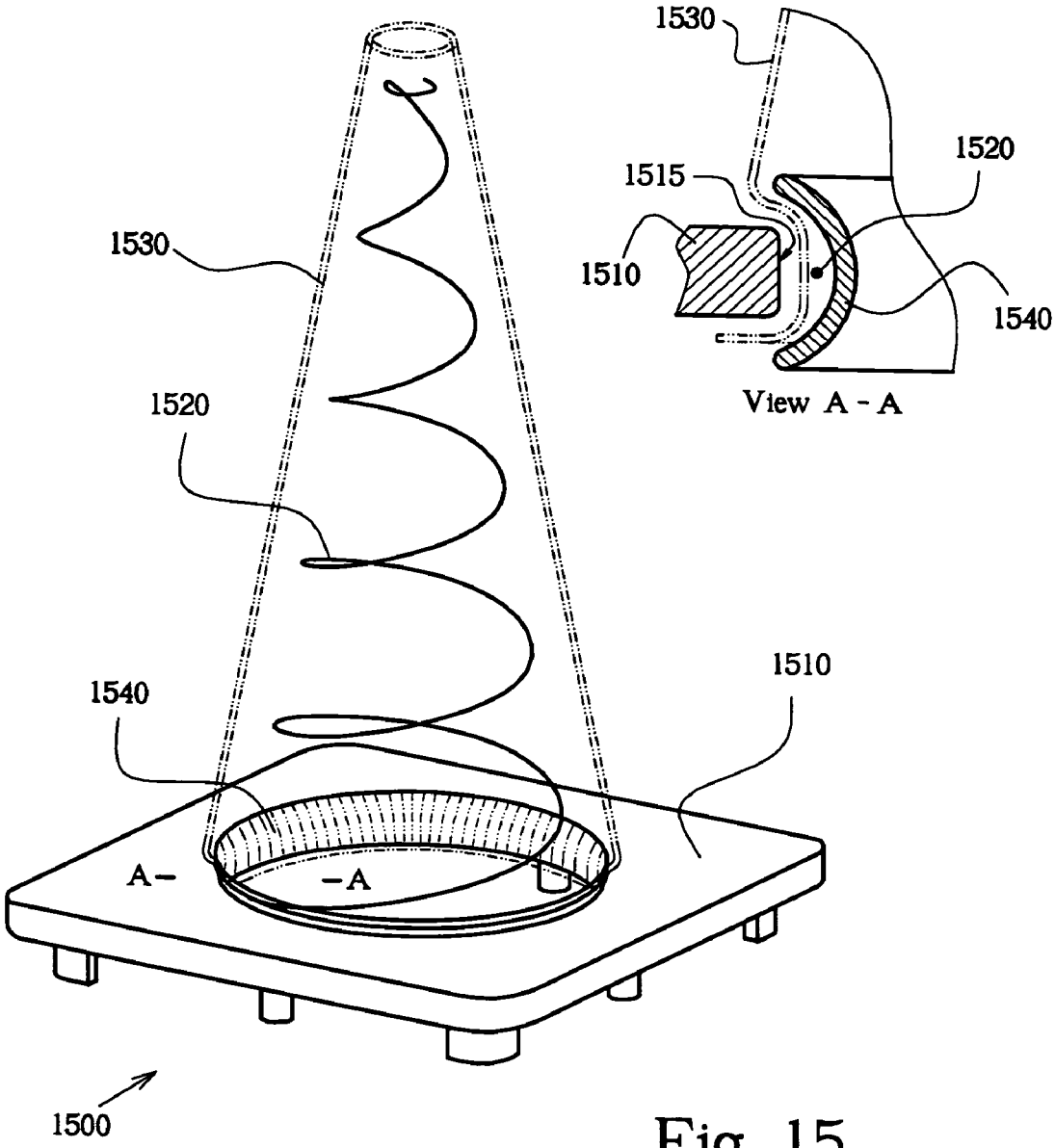
FIG. 15 shows a safety cone with modularly combined components according to the present invention.

In one embodiment of the present invention the safety cone is based on modular components such as at least a base, a flexible means and a cover that are modularly combined to form a safety cone. The use of modular components would allow the use of recycle components, such as a rubber base, so that one or more of these components can be recycled. FIG. 15 shows an example of a modular safety cone assembly 1500 with a base 1510, a spiral 1520, a cover 1530 and a ring 1540 using a cross sectional view of marker device assembly 1500. Ring 1540 could be used sort of as a quick-connector for the modular components (i.e. base 1510, spiral 1520 and cover 1530) of the safety cone. Note that for clarity purposes in the inset figure, only part of the bottom ring of spiral 1520 is shown and spiral 1520 should in fact extend upward as shown by 1500. The key idea of ring 1540 is to position spiral 1520 and cover 1530 against the inner edge 1515 of base 1510. Ring 1540 could be made out of any type of material (e.g. a plastic, rubber or polyester) as long as it has enough strength to hold together base 1510, spiral 1520 and cover 1530 as well as enough flexibility to assemble (de-assemble) these three parts together (apart). In one embodiment, the ring could include a buckle mechanism that when buckled tightens and combines all modular parts that need to the combined.

Figure 16:
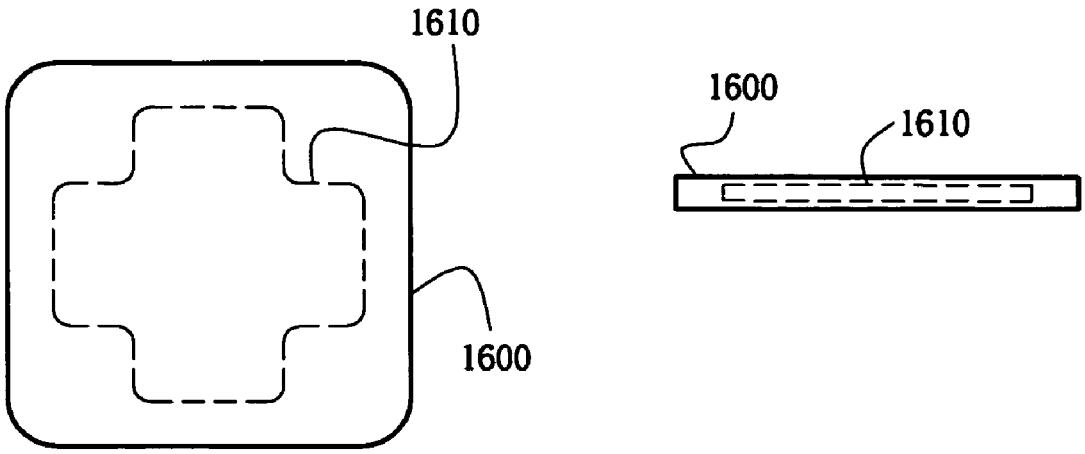
FIG. 16 shows a base with a reinforcement according to the present invention.
Figure 17:
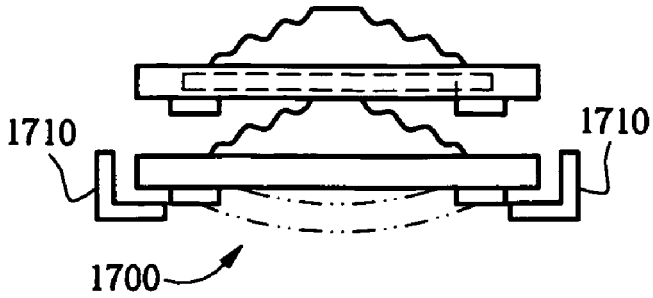
FIG. 17 shows an example of safety cones in spring-loaded position according to the present invention.
Figure 18:
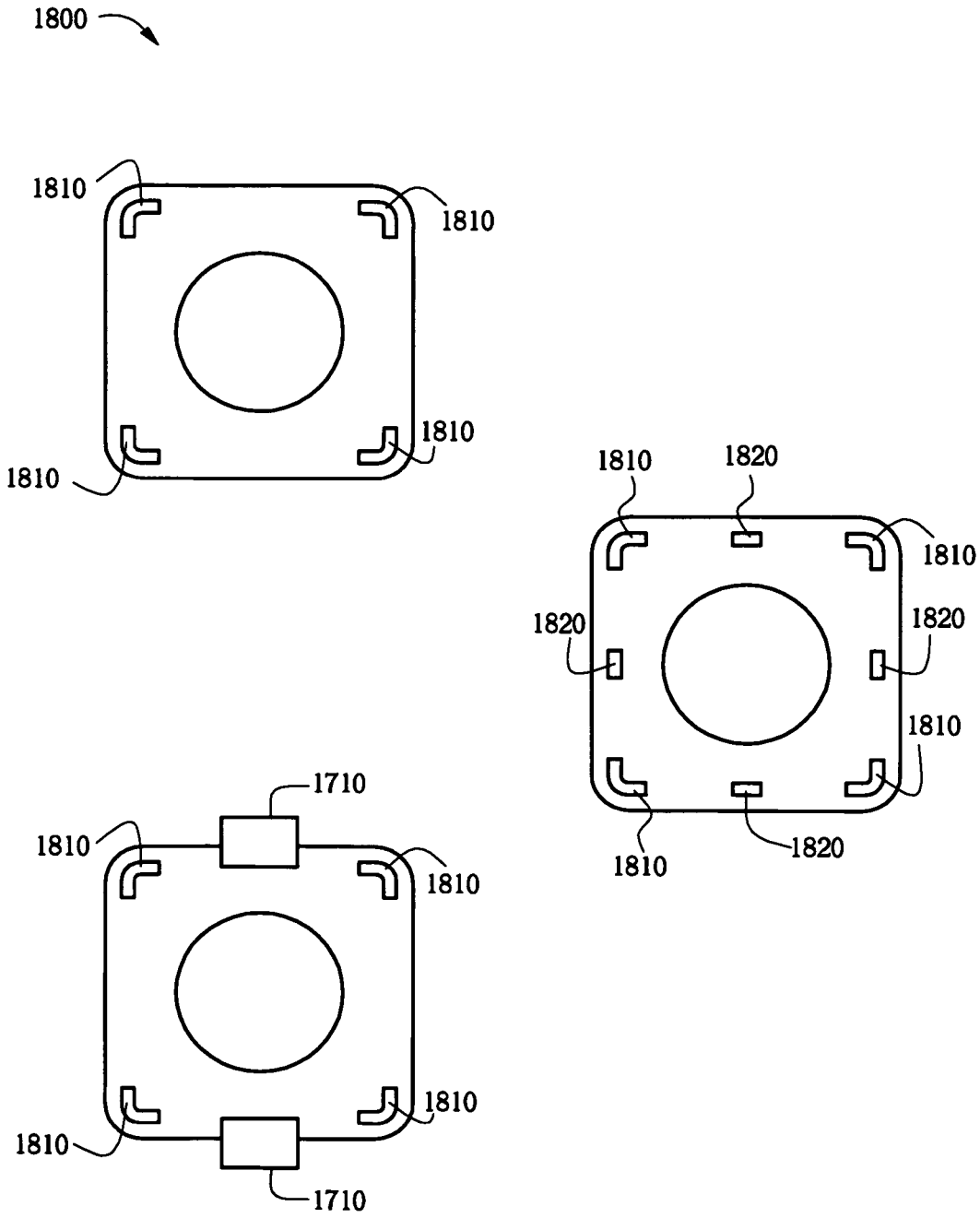
FIG. 18 shows a base according to the present invention.
Figure 19:
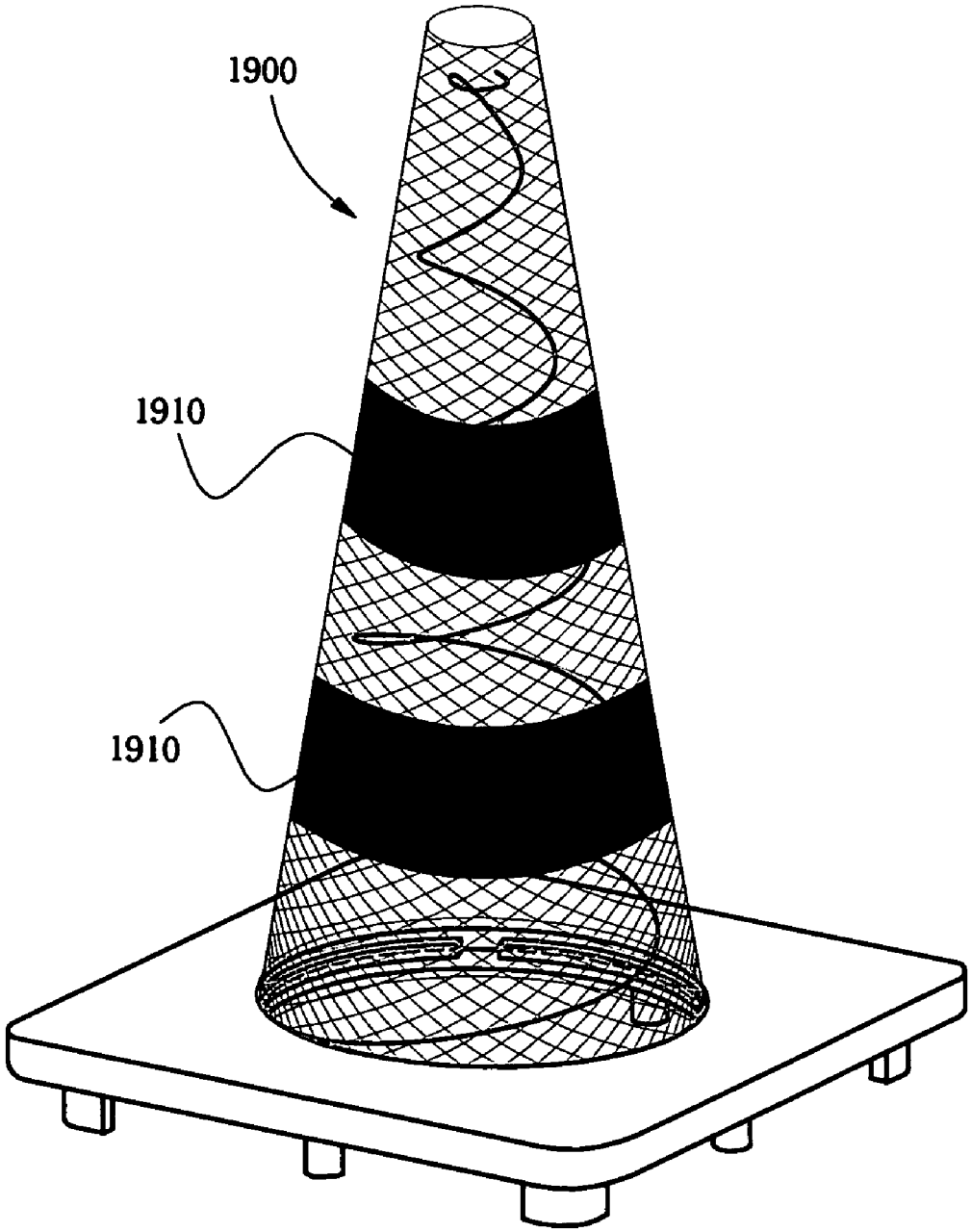
FIG. 19 shows a mesh-based cover according to the present invention.

In one embodiment shown in FIG. 16, the base 1600 of a flexible safety cone would have a reinforcement 1610 placed within base 1600 to prevent bending of base 1600 when a plurality of safety cones are stacked inside the receptacle in spring-loaded position. The potential bending is shown in FIG. 17 by the dashed line 1700. Reinforcement 1610 could be made out of any type of material as long as it provides the necessary strength to, for instance, a rubber base and prevent bending of the rubber base. The reinforcement should not create a rigid base to jeopardize stability of the safety cone. The shape of reinforcement 1610 is not limited to the shape shown in FIG. 16 but could be any type of shape. In another embodiment, the base would be preferred to have a weight up to about 3 kg and preferably between 1-3 kg. This would be in contrast to the much heavier conventional cone bases. The base of the cones relevant to the present invention should have a relatively heavier base than the combined parts of the flexible cone part, the cover and potentially the reflective material. This provides for relatively low center of gravity of the safety cone promoting stability.

A consideration for the bottom of the base is to only have support structures or "feet" to support the stability or "standing" of the safety cone. However, any additional support structures that might potentially obstruct the releasing means 1710 (See FIG. 17) should preferably be left out in the design of the base. In one embodiment shown in FIG. 18, base 1800 has four corner feet 1810 which leave enough room for the releasing means 1710 to be positioned underneath the base. For instance, "support feet" like 1820 should preferably be avoided at places where releasing means 1710 potentially holds base since it might create an unstable holding position.

Figure 20:
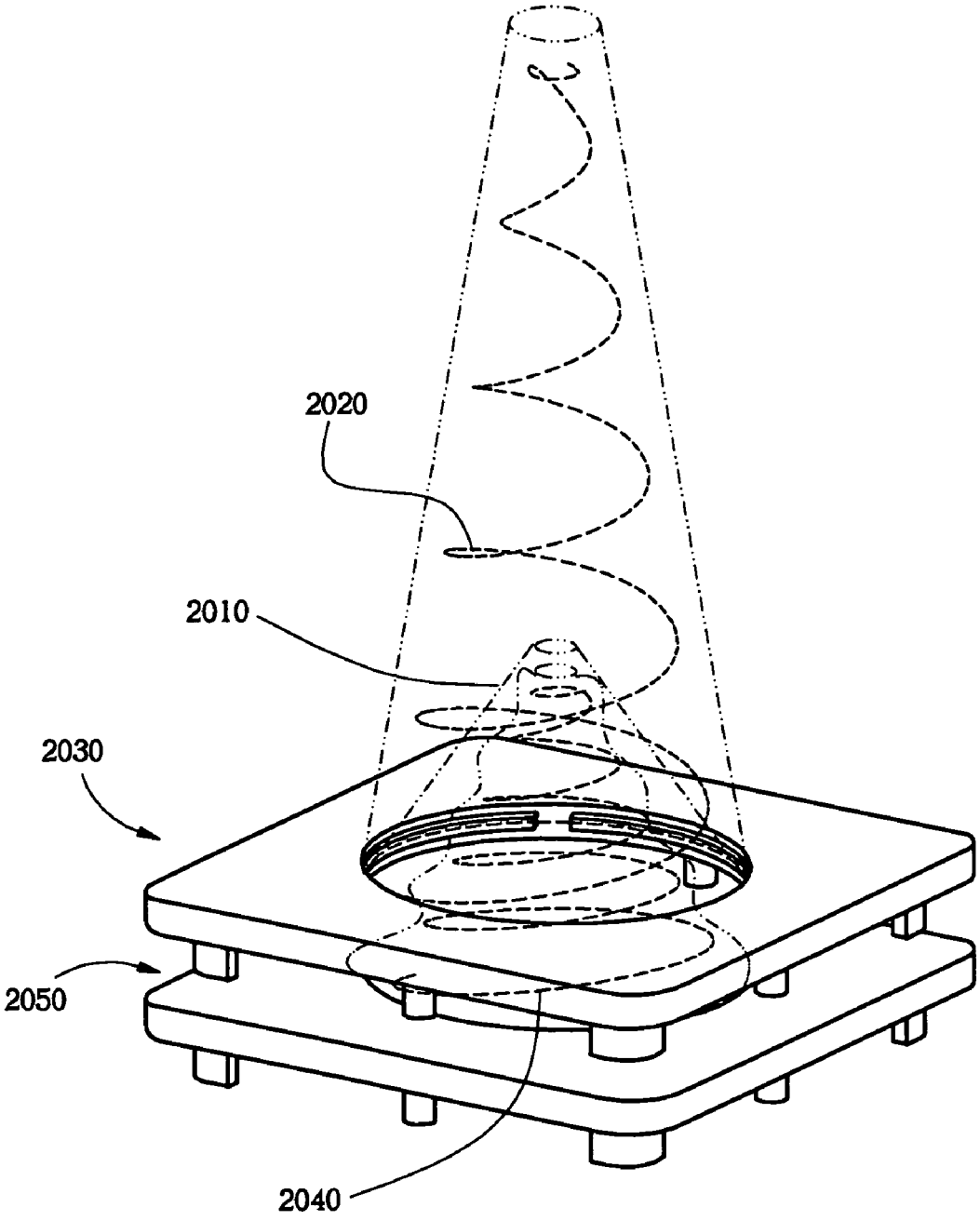
FIG. 20 shows a cone-shaped material as part of a safety cone to assist in stacking safety cones according to the present invention.

In one embodiment as shown in FIG. 20, the safety cones includes a cone shaped material 2010, for instance, but not limited to a fabric, that could be positioned inside the flexible means 2020 of a first safety cone 2030 to guide, hold in place or assist in compressing the flexible means 2040 of a second safety cone 2050 when the first safety cones is stacked on top of the second safety cone.

Figure 21:
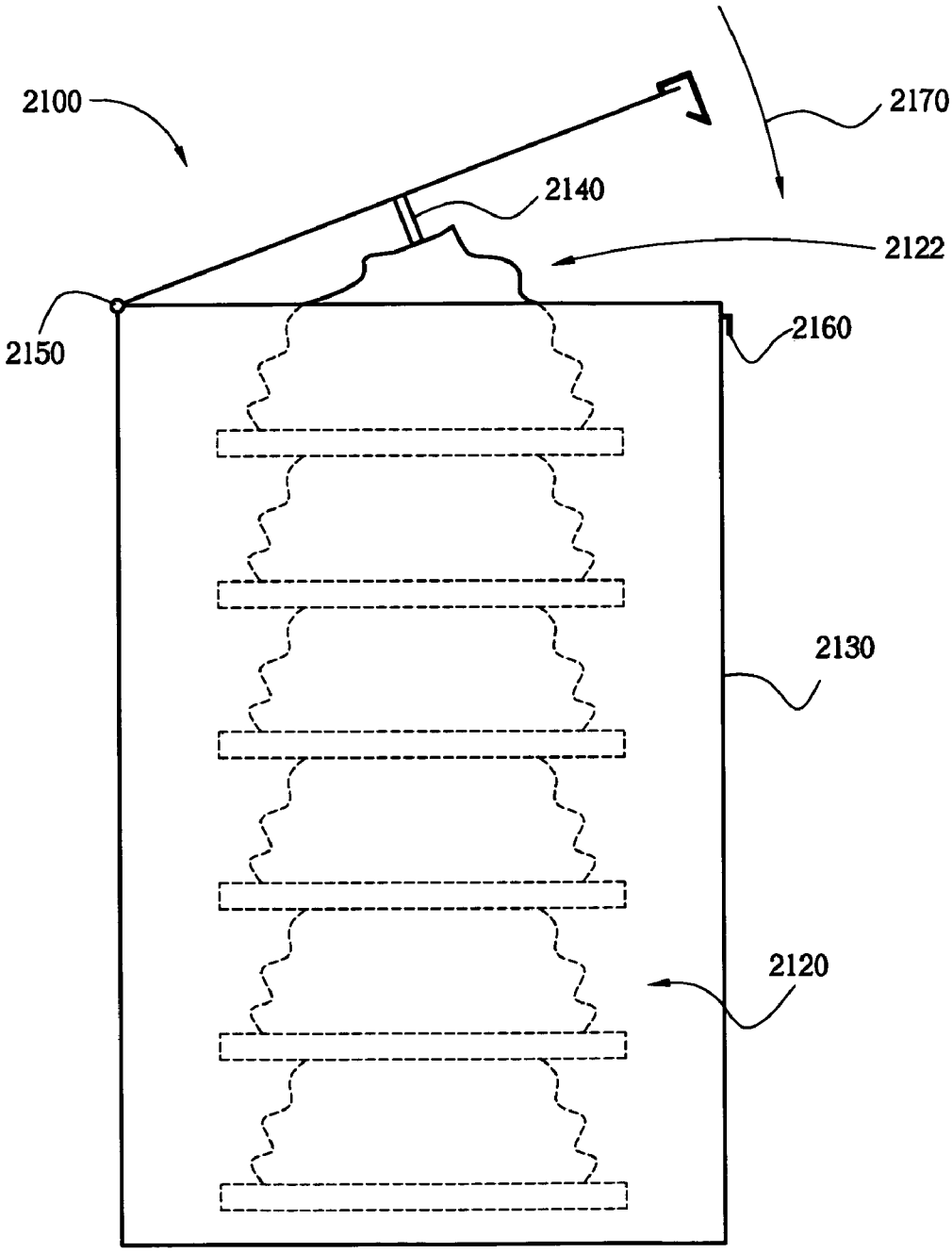
FIG. 21 shows a cassette with a second latch to hold a plurality of safety cones in spring-loaded position according to the present invention.

In one embodiment as shown in FIG. 21, the safety cones could be held in a spring-loaded position by a holding means

2100 that is positioned on top of the plurality of stacked safety cones 2110. Holding means 2100 would hold a plurality of safety cones 2120 in place inside receptacle 2130 so that the spring-loaded safety cones do not "spring out". Holding means 2100 could also include a notch 2140 which can be used to align the upper safety cones 2122. Notch 2140 is sized to easily fit in the top opening of safety cones 2122. Holding means 2100 is movably attached 2150 to receptacle 2130 and could be detachably attached to receptacle 2130 at for instance location 2160 when holding means 2100 is closed down 2170.

Figure 22:
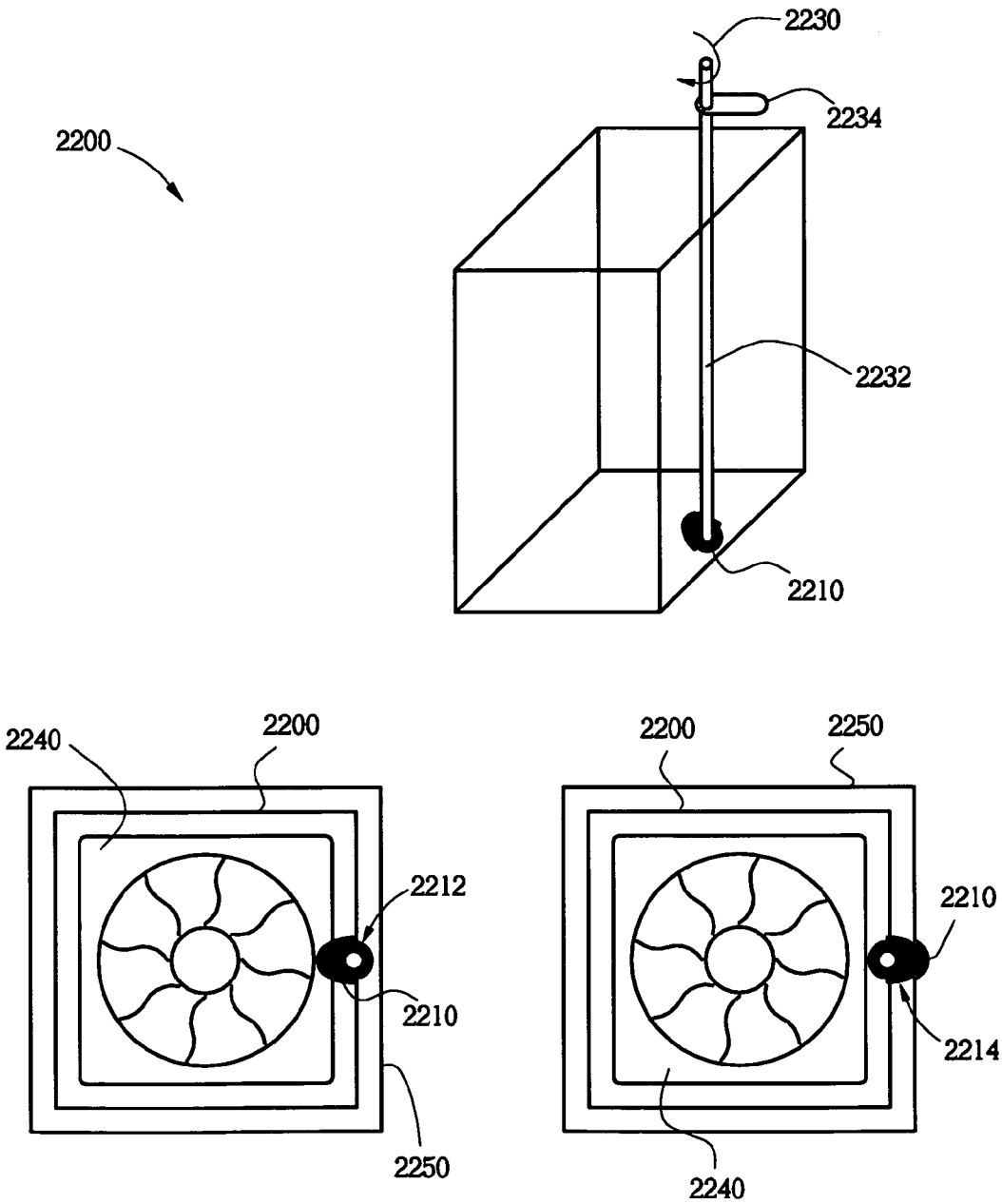
FIG. 22 shows a cassette with a first latch to hold a plurality of safety cones and alternatively latch the cassette to the receptacle according to the present invention.

The example discussed with respect to FIG. 21 could be varied from the cones being held in the receptacle to the cones being held in a cassette. FIG. 22 shows a cassette 2200 which could be a wire frame or a construction sufficient to hold in place a plurality of safety cones. The bottom of cassette 2200 should include an opening to allow release of the safety cones. In case of the receptacle, the releasing means controls the release of the safety cones. In case of the cassette 2200 a first latch 2210 is used that can be positioned in a holding position 2212 or a releasing position 2214. This holding and releasing position of first latch 2210 is accomplished by for instance a rotary movement 2230 of first latch 2210 through a bar 2232 connected with preferably a handle 2234 that is positioned at the top of the cassette. The position of the handle and consequently the position of the bar are not limited to this example and could also be situated near the bottom of the cassette 2200. First latch 2210 could be a half circle as shown or could be a bar; there is no limitation to the shape of first latch 2210 as long as a holding and releasing position can be achieved.

The safety cones 2240 can be placed inside the cassette with the flexible means in extended position or in spring-loaded position. Cassette 2200 could be removably placed inside receptacle 2250 (See top view 2260). First latch 2210 can be used to removably attach cassette 2200 to receptacle 2215 when placed inside receptacle 2250 (attachment is established by moving first latch from position 2212 to position 2214. A matching opening will then be included as part of the receptacle to the appropriate place. Note that once in position 2214, the safety cones are simultaneously released to the bottom of the receptacle so that they are ready to be release by the releasing means (as discussed supra). A second latch can be used to hold the plurality of said safety cones inside the cassette. The second latch would be similar to the holding means (with or without notch) as discussed with reference to FIG. 21.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For instance, in one variation the safety cones could include a light source that could be automatically activated upon release and placement of the safety cone to a position on a ground surface. Another variation is that the size of the safety cones is not limited to one particular size or standard since different sizes and shapes of flexible safety cones could be used.

Figure 23:
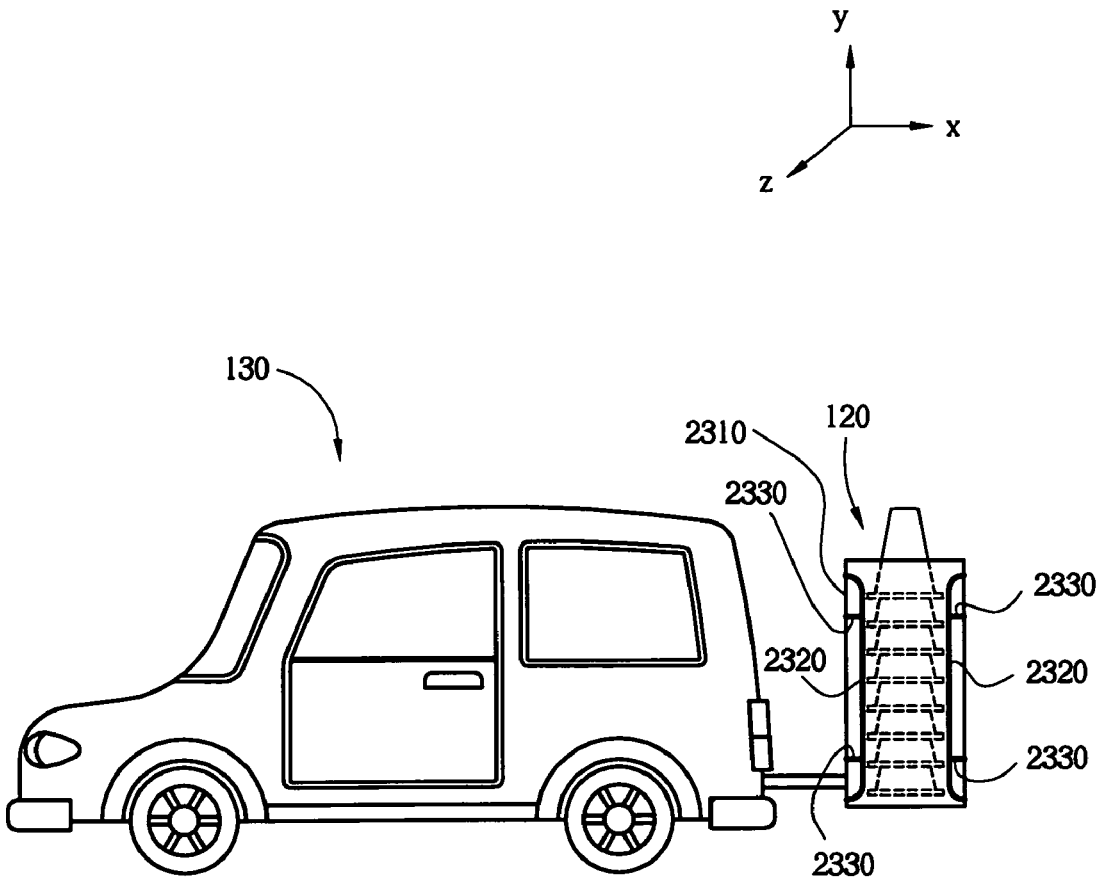
FIG. 23 shows a receptacle including a guiding means to guide the safety cones according to the present invention.

Still another variation is shown in FIG. 23 whereby receptacle 2310 further includes a guiding means to guide the safety cones within receptacle 2310. Guiding means could, for instance, include one or more surfaces 2320 whereby each of the surfaces 2320 are movably connected to receptacle 2310 by, for instance, spring loaded mechanisms 2330. The key idea is that the guiding means guides the safety cones in a position so that the safety cones maintain upright and are nicely guided downward every time a safety cones is released. As a person of average skill in the art would readily appreciate, a variety of mechanisms could be employed to movably connect surfaces 2320 and the present invention is not limited to spring loaded mechanisms 2330. Furthermore, the present invention is also not limited to surfaces 2320 as shown in FIG. 13 since it would also be possible to have a guiding means as a bar positioned through the center of the safety cone (not shown).

Figure 24:
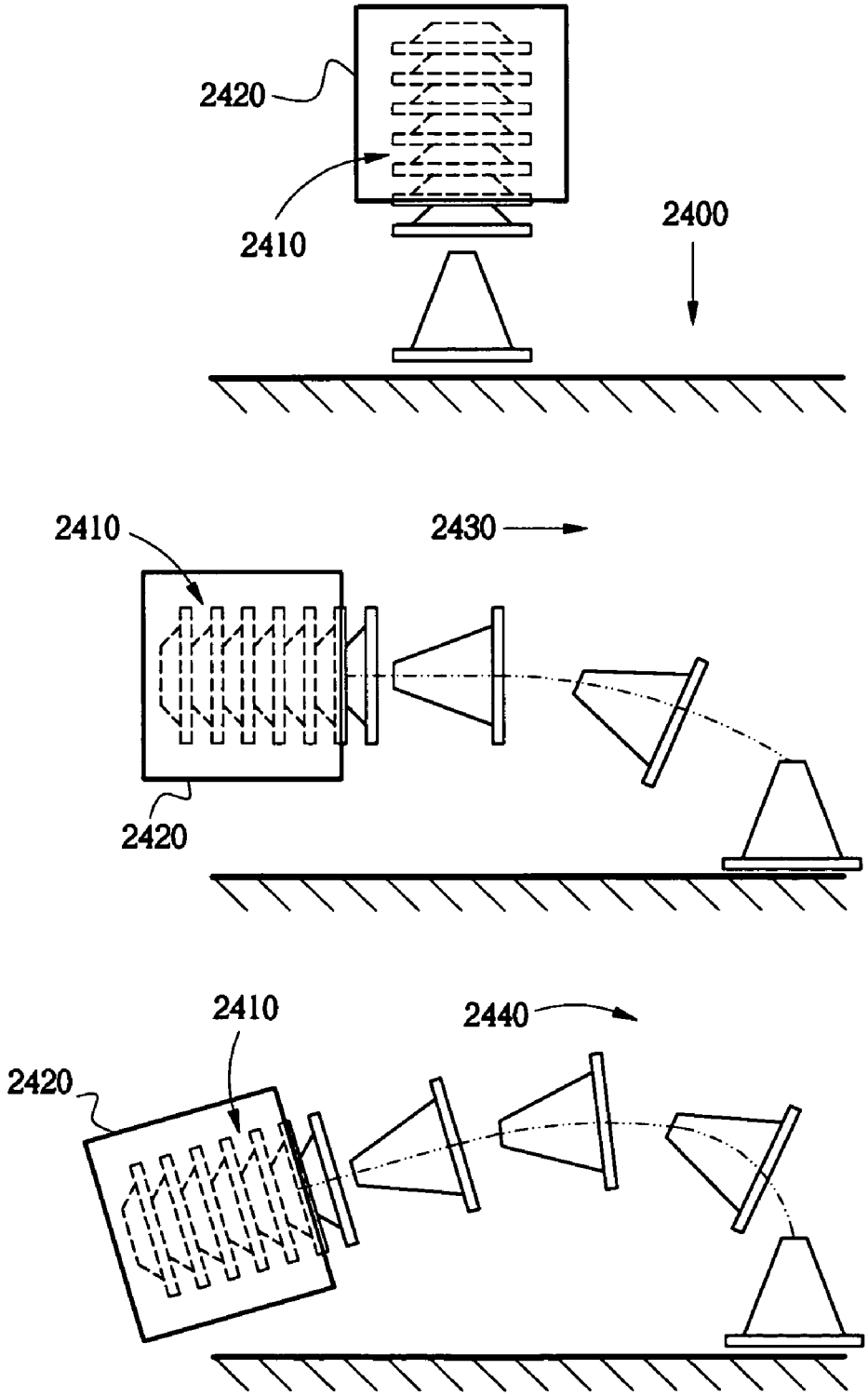
FIG. 24 shows different examples of positions for the receptacle and releasing or shooting safety cones from the receptacle according to the present invention.

Yet another variation is that the position of the receptacle is not limited to a vertical releasing direction 2400 from a moving vehicle as shown in FIG. 24. For instance, since the safety cones can be stored in a spring-loaded position 2410 in the receptacle 2420 they can even be released in a reverse direction 2430 from the driving direction or in a slightly upward direction 2440. The flexible cone part and the relatively heavier base with respect to the flexible cone part ensure a correct landing and ultimate stable position of the safety cone as discussed supra.

Figure 25:
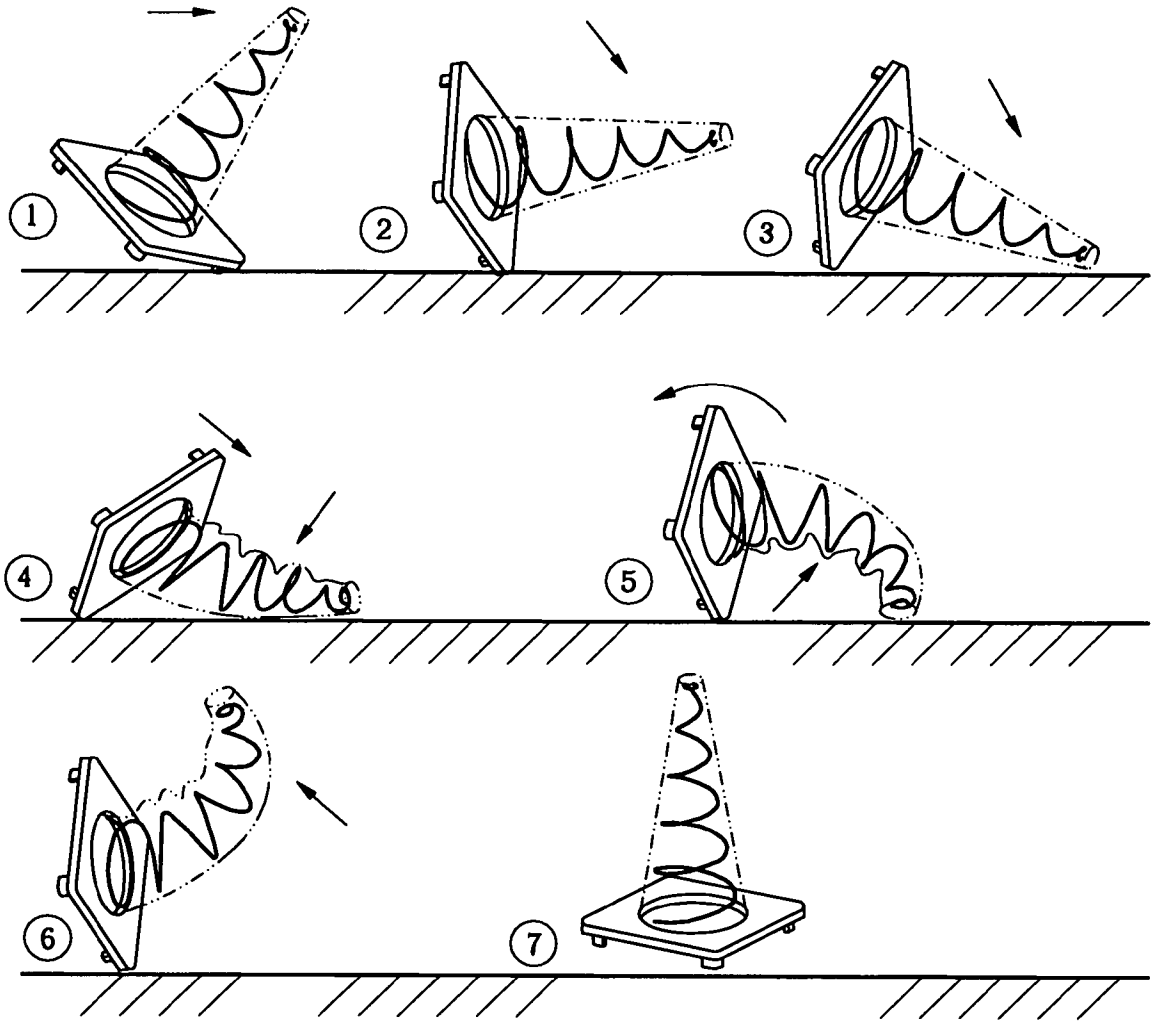
FIG. 25 shows an exemplary embodiment of a safety cone being subject to a perturbation significantly strong enough to make the safety cone tip over and its recovery to upright and original position on a ground surface according to the present invention.

Even though the design of the flexible safety cone has a impulse response to handle perturbation(s) during placement and use on the road, it might be possible that for whatever reason the flexible safety cone could be knocked over due to a strong perturbation. However, the design of the flexible cone part, due to the fast impulse response of the part and potentially also due to base, with or without the reinforcement, could act as a "spring-board" or "kick-back" mechanism that could recover the safety cone back to its upright position. The flexible cone part is spring-loaded during the knock-over and it is this spring-loaded tension that provides the force to recover back upright. This mechanism is illustrated in FIG. 25 by steps 1-7.

All such variations are considered to be within the scope and spirit of the present invention as defined by the following claims and their legal equivalents.

What is claimed is:

1. A safety cone placing device, comprising:

(a) a receptacle removably attached to a vehicle for holding a plurality of safety cones each having a flexible cone part on top of a base, wherein said plurality of safety cones are being held by said receptacle in a compressed position or in a spring-loaded position by respectively having said flexible cone part compressed or spring-loaded;

(b) a releasing means coupled to said receptacle for releasing one of said plurality of safety cones from said receptacle and from said compressed or spring-loaded position directly to a position on said ground surface and for preventing the remainder of said plurality of safety cones from being released from said receptacle, wherein each of said plurality of safety cones is capable of undergoing perturbations during said releasing and of staying upright and stable upon release from said receptacle; and (c) a control means coupled to said releasing means for controlling said releasing means such that said plurality of safety cones are released and placed at different positions on said ground surface while said vehicle moves.

* * * * *